United States Patent [19]

Houle

[11] 4,399,569

[45] Aug. 23, 1983

[54] MANUAL IN-DOOR LOCK ARRANGEMENT FOR BATHING UNITS

[75] Inventor: Raymond T. Houle, Traverse City, Mich.

[73] Assignee: Silchor, Traverse City, Mich.

[21] Appl. No.: 362,484

[22] Filed: Mar. 26, 1982

[51] Int. Cl.[3] ..... A47K 3/02

[52] U.S. Cl. ..... 4/555; 4/556; 4/538; 4/661

[58] Field of Search ..... 4/661, 555, 556, 557, 4/558, 552, 596, 601, 538, 584, 604, 605

[56] References Cited

U.S. PATENT DOCUMENTS

| | | | |
|---|---|---|---|
| 97,729 | 12/1935 | Davock . | |
| D. 143,204 | 12/1945 | Fleischhauer | D23/55 |
| 229,180 | 11/1973 | Mollerstedt | 165/11 R |
| 237,616 | 11/1975 | Gordon | 182/17 |
| 237,709 | 11/1975 | Jacuzzi | 128/567 |
| 254,206 | 2/1980 | Ogden | 384/444 |
| 255,932 | 7/1980 | D'Innocente et al. | 434/222 |
| D. 257,058 | 9/1980 | Laver | D23/55 |
| 2,079,770 | 5/1937 | Robinson | 4/584 |
| 2,081,728 | 5/1937 | Bassett | 4/590 |
| 2,166,469 | 3/1938 | Houston | 4/569 |
| 2,456,275 | 12/1948 | Harris | 4/556 |
| 2,566,495 | 9/1951 | Miyakawa | 4/590 |
| 2,569,825 | 10/1951 | Otis | 4/556 |
| 2,570,053 | 10/1951 | Fowler et al. | 4/556 |
| 2,576,623 | 11/1951 | McLaughlin | 4/555 |
| 2,587,335 | 2/1952 | Landergott | 4/542 |
| 2,804,629 | 9/1957 | Ring | 4/556 |
| 2,936,463 | 5/1960 | Tracy | 4/607 |
| 2,977,604 | 4/1961 | Miller | 4/556 |
| 3,066,316 | 12/1961 | Russell | 4/556 |
| 3,113,323 | 12/1963 | Beardsley | 4/549 |
| 3,366,978 | 2/1968 | Jones | 4/540 |
| 3,371,354 | 3/1968 | Hayslett | 4/555 |
| 3,371,357 | 3/1968 | Berthelsen et al. | 5/83 |
| 3,377,630 | 4/1968 | Robare | 4/444 |
| 3,380,078 | 4/1968 | Hanson | 4/555 |
| 3,416,166 | 12/1968 | Hanson | 4/555 |
| 3,423,769 | 1/1966 | Cowley | 4/556 |
| 3,467,969 | 9/1969 | Szekely | 4/543 |
| 3,496,579 | 2/1970 | Peterson | 4/590 |
| 3,562,821 | 2/1971 | Queen | 4/604 |
| 3,604,018 | 9/1971 | Moran | 4/556 |
| 3,613,127 | 10/1971 | Bond | 4/596 |
| 3,648,296 | 3/1972 | Craft et al. | 4/444 |
| 3,662,409 | 5/1972 | Johansson | 4/560 |
| 3,663,971 | 5/1972 | Bonhote | 4/556 |
| 3,703,733 | 11/1972 | McLoughlin | 4/556 |
| 3,719,960 | 3/1973 | Russell | 4/556 |
| 3,736,924 | 6/1973 | Jacuzzi et al. | 128/66 |
| 3,815,163 | 6/1974 | Sullivan | 4/562 |
| 3,827,086 | 8/1974 | Seymour et al. | 52/35 |
| 3,827,087 | 8/1974 | Cuthbertson | 4/540 |
| 3,863,275 | 2/1975 | Brendgord et al. | 4/556 |
| 3,864,762 | 2/1975 | Finch et al. | 4/555 |
| 3,879,770 | 4/1975 | Grant | 4/563 |
| 3,900,906 | 8/1975 | Berthelsen | 5/62 |
| 3,924,278 | 12/1975 | Ekman | 4/540 |
| 3,964,472 | 6/1976 | Nicollet | 128/66 |
| 4,067,071 | 1/1978 | Altman et al. | 4/546 |
| 4,080,710 | 3/1978 | Hess | 29/416 |
| 4,099,272 | 7/1978 | Sowder | 4/555 |
| 4,112,524 | 9/1978 | Johansson . | |
| 4,118,810 | 10/1978 | Brickhouse et al. | 4/556 |
| 4,160,292 | 7/1979 | Kuether et al. | 4/615 |
| 4,202,060 | 5/1980 | Touze | 4/556 |
| 4,346,485 | 8/1982 | Reed et al. | 4/556 X |
| 4,360,935 | 11/1982 | Barrett, Sr. | 4/555 |
| 4,365,367 | 12/1982 | Houle et al. | 4/555 |

FOREIGN PATENT DOCUMENTS

| | | | |
|---|---|---|---|
| 1913248 | 10/1970 | Fed. Rep. of Germany . | |
| 695403 | 12/1930 | France . | |
| 7825000 | 8/1978 | France . | |
| 2434617 | 3/1980 | France . | |
| 1213358 | 11/1970 | United Kingdom | 4/555 |
| 1226206 | 3/1971 | United Kingdom | 4/555 |
| 1554165 | 10/1979 | United Kingdom | 4/555 |

OTHER PUBLICATIONS

Patent Application Ser. No. 187,522, filed Sep. 15, 1980, Entitled, *Apparatus and Method for Bathing Invalids.*

Patent Application Ser. No. 187,338, filed Sep. 15, 1980, Entitled, *Door Controller for Bathing Units.*

*Domestic Engineering,* May 1978, p. 6A, top left item, "Fulljet Nozzles"and "Floodjet Nozzles", by Spraying Systems Company (publication date unknown).

*Primary Examiner*—Henry K. Artis

*Attorney, Agent, or Firm*—Price, Heneveld, Huizenga & Cooper

[57] ABSTRACT

A manual, in-door lock arrangement is provided for invalid bathing units and the like, of the type comprising a bathtub having a lateral opening in one side thereof for ingress and egress, and a door slidably mounted on a hinge-less track assembly for vertically translating the door between open and closed positions to selectively open and close the bathtub opening. A compression seal is disposed between the mating edges of the door and bathtub opening to form a watertight seal therebetween. The lock arrangement comprises a hand-operated actuator arm pivotally mounted on the exterior side of the door, and an elongate rod pivotally mounted within the door with latch arms attached to opposite ends of the rod. Latch plates are mounted on the track assembly at a location adjacent the latch arms when the door is in the closed position. A link mechanism interconnects the actuator arm and the bar, whereby downward pivotal motion of the actuator arm rotates the latch arms into engagement with the latch plates, and positively pulls the door down into the closed position. An over-centered latch mechanism securely locks the door in the closed position.

27 Claims, 9 Drawing Figures

MANUAL IN-DOOR LOCK ARRANGEMENT FOR BATHING UNITS

CROSS-REFERENCE TO RELATED APPLICATIONS

The present application is related to co-pending U.S. patent applications Ser. No. 187,522, filed Sept. 15, 1980, now U.S. Pat. No. 4,365,367, entitled APPARATUS AND METHOD FOR BATHING INVALIDS, and Ser. No. 362,485, filed Mar. 26, 1982, entitled SHOWER SPRAY ARRANGEMENT FOR BATHING UNITS, which are hereby incorporated by reference.

BACKGROUND OF THE INVENTION

The present invention relates to bathing units for invalids and others with impaired ambulatory ability, and in particular to an in-door lock arrangement therefor.

Bathing units for invalids and the like are generally known in the art. A unique invalid bathing apparatus is disclosed in the above-referenced, co-pending U.S. patent application Ser. No. 187,522. This bathing apparatus comprises an enclosure having a bathtub with upstanding walls which form a stall. The bathtub includes a seat having an anatomical contour, and a lateral opening adjacent the seat to permit invalid ingress and egress. A door with a generally wedge-shaped contour mates with and selectively closes the bathtub opening, and includes a seal compressed between the opening lip and the door to form a seal which is sufficiently watertight to permit immersal bathing of a seated invalid. The door is slidably mounted on a hingeless track assembly, which guides the door vertically into a closed position and pivots the door as it is raised into a horizontal, overhead storage position. The bathtub seat and opening are mutually oriented so as to permit an attendant to laterally move the invalid from a wheelchair directly onto the bathtub seat with minimum strain and hazard.

In the bathing apparatus set forth in co-pending patent application Ser. No. 187,522, the door is locked in the closed position by a pair of wedge-shaped bolts, which are slidably mounted in the door, and protrude from opposite sides of the door into mating, apertured plates. An electrically operated solenoid extends and retracts the wedge-shaped bolts between locked and unlocked positions.

A foot operated door latch arrangement is disclosed in co-pending U.S. patent application Ser. No. 187,338. This mechanism is mounted in the bathtub portion of the bathing apparatus and includes a pedal pivotally anchored on the right-hand side of the bathtub. In this treadle arrangement, a linkage mechanism connects the pedal with pivotal latches on the left and right-hand sides of the bathtub, which selectively engage the roller brackets on the left and right-hand sides of the door. The pedal is slightly flexible in the lateral direction, in the nature of a leaf spring, and is translated around a fixed stop, which holds the lever in a locked position. When the pedal is disengaged from the fixed stop, a spring returns the latch members to a normally open or unlocked position.

It has been determined that a manually operated door lock arrangement is generally preferred for bathing units, such as the above-described apparatus, because they are very reliable, capable of achieving a secure watertight seal between the door and the tub, and are relatively economical to manufacture and maintain. The treadle actuated mechanism disclosed in co-pending application Ser. No. 187,338 may be considered by some users to be somewhat inconvenient to manipulate. Further, because large forces can be applied to the pedal mechanism, damage can result to the door if the unit is misused, particularly when attempts are made to lock the door before it is completely closed.

One aspect of the present invention is a hand-operated lock arrangement for bathing units, which is mounted within the interior of the door and comprises an actuator arm positioned on the exterior side of the door, and a locking rod, rotatably mounted in the interior of the door and extending across the width thereof. Latch arms are attached to the ends of the locking rod, and abut stationary latch plates. A link mechanism connects the actuator arm with the locking rod, whereby downward pivotal movement of the actuator arm rotates the latch arms into engagement with the latch plates to positively draw the door down into the closed position. An over-centered latch mechanism locks the door closed. Preferably, the lock arrangement is adjustable to vary seal compression.

Another aspect of the present invention is a mechanism to supply pressurized water to spray nozzles mounted in the door, and comprises a pair of mating fittings mounted in the bathtub and the door, which are translated into an aligned relationship when the door is closed. One of the fittings is mounted for reciprocation, and is extended into abutment with the other fitting to form a watertight seal therebetween. Preferably, the reciprocating fitting is operably connected with the actuator arm, and is automatically reciprocated into and out of engagement with the mating fitting when the door is locked and unlocked.

The principal objects of the present invention are to provide a manual, in-door lock arrangement for invalid bathing units and the like, which positively draws the door down into a secure, sealing relationship with the bathtub opening. A hand-operated lever is provided with sufficient mechanical advantage to achieve a watertight seal, yet prevents damage to the door, even when misused. The locking arrangement is adjustable to vary downward pressure on the compression seal, as well as equalize lateral compression of the seal. Specially designed plumbing fittings reliably supply pressurized water to shower nozzles mounted in the door, and prevent inadvertent leakage when the door is raised to its overhead storage position. The lock arrangement is quite reliable, efficient in use, economical to manufacture, capable of a long operating life and particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
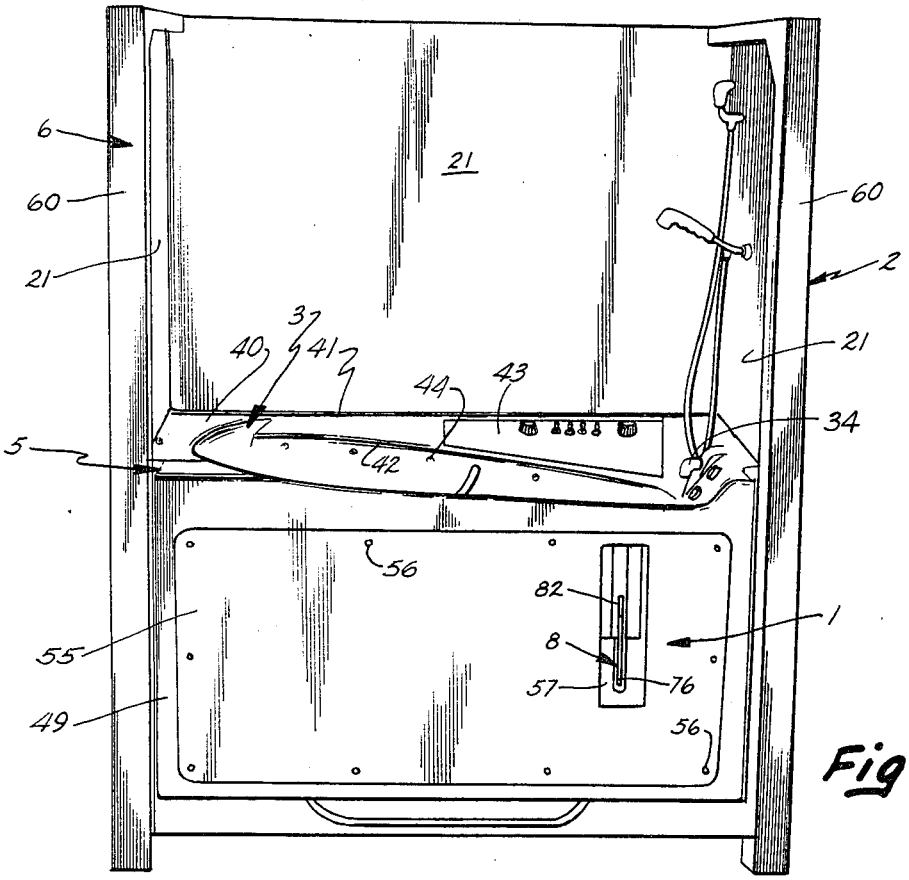
FIG. 1 is a front perspective view of a bathing apparatus having a manual, in-door lock arrangement embodying the present invention.

For purposes of description herein, the terms "upper," "lower," "right," "left," "rear," "front," "vertical," "horizontal" and derivatives thereof shall relate to a seated bather as oriented in FIG. 1. However, it is to be understood that the invention may assume various alternative orientations except where expressly specified to the contrary.

Figure 2:
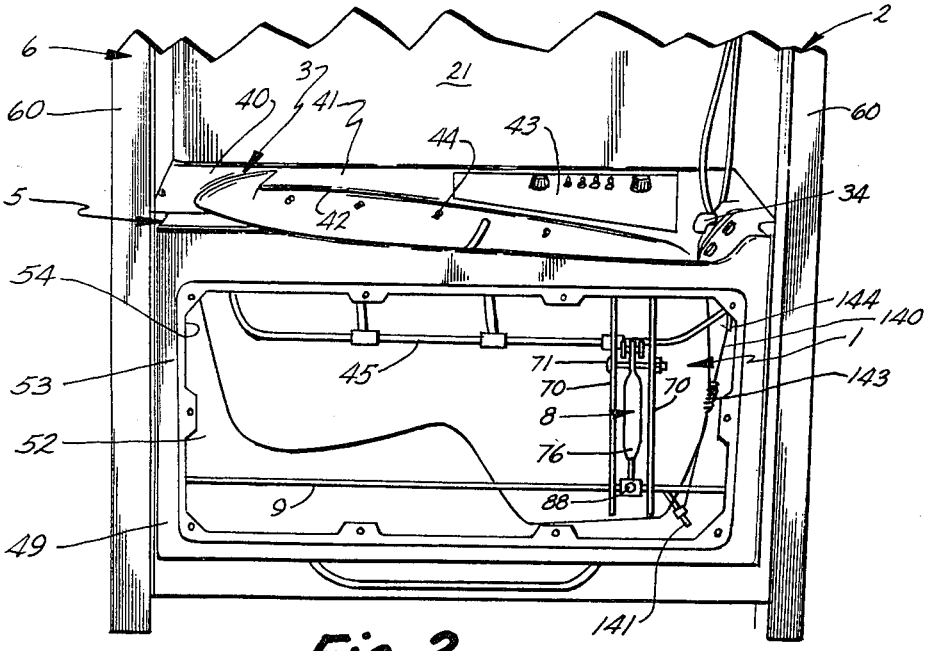
FIG. 2 is a fragmentary, front perspective view of the bathing apparatus, with a front door panel thereof removed to reveal internal construction.
Figure 3:
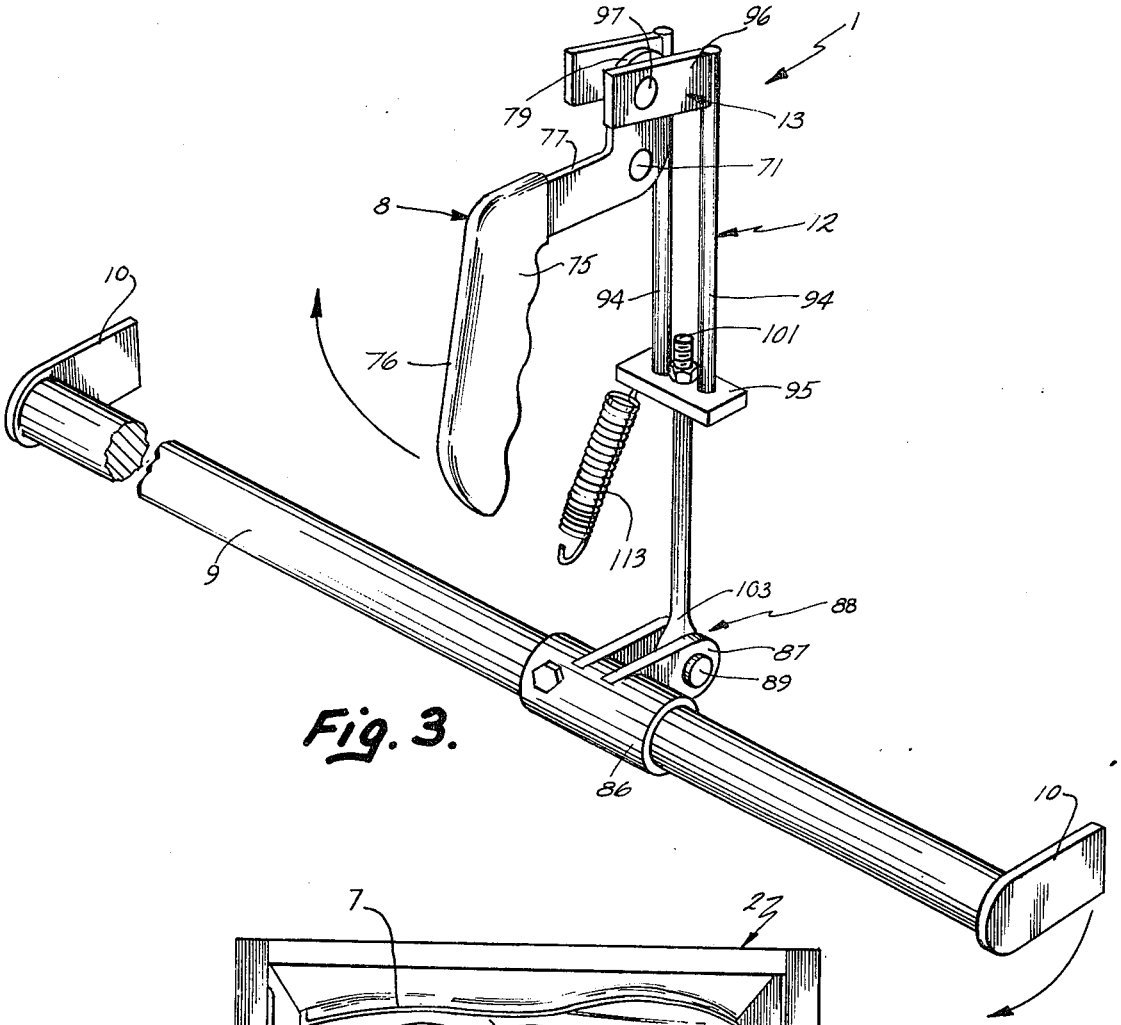
FIG. 3 is a partially schematic, perspective view of the lock arrangement.

The reference numeral 1 (FIG. 1) generally designates a manual, in-door lock arrangement for invalid bathing units, such as the illustrated bathing apparatus 2. Bathing unit 2 comprises a bathtub 3 having a lateral opening 4 (FIG. 4) in one side thereof for ingress and egress. A door 5 is slidably mounted on a hingeless track assembly 6 to guide door 5 between open and closed positions to selectively open and close bathtub opening 4. A compression seal 7 is disposed between the mating edges of door 5 and bathtub opening 4 to form a watertight seal therebetween. Lock arrangement 1 (FIG. 2) comprises a hand-operated actuator arm 8 pivotally mounted on the exterior side of door 5, and an elongate bar or rod 9 pivotally mounted within door 5 with latch arms 10 (FIG. 3) attached to the opposite ends of rod 9. Latch plates 11 (FIG. 6) are mounted on track assembly 6, and are positioned adjacent latch arms 10 when the door 5 is in the closed position, as illustrated in FIGS. 1 and 2. A link mechanism 12 interconnects actuator arm 8 and rod 9, whereby downward rotation of actuator arm 8 rotates latch arms 10 into engagement with latch plates 11, and positively pulls door 5 down into the closed position. An over-centered latch arrangement 13 securely locks door 5 in the closed position.

Aside from the improvements discussed in greater detail hereinafter, bathing apparatus 2 is substantially identical with the apparatus disclosed in my above-referenced, co-pending U.S. patent application Ser. No. 187,522. In the illustrated example, bathing unit 2 (FIG. 4) includes an enclosure 20, having upstanding walls 21 along the left-hand side and ends of the bathtub 3 to form a shower stall. Bathtub 3 comprises a seat 22, a back 23, and a foot well 24, which are integrally molded in one piece from a durable, rigid, non-corrosive material such as fiberglass or the like. Seat 22 is disposed at an elevation substantially coextensive with that of a conventional wheelchair, and is inclined slightly to the rear. The forward edge 25 of seat 22 is rounded, and the rearward edge is arcuately shaped and blends smoothly into back 23. Back 23 is angled slightly rearwardly, so that the bather is seated in a slightly reclined position in the bathing unit.

Foot well 24 is disposed below and forward of seat 22, and comprises a shower reservoir with a drain 30 mounted therein. Foot well 24 tapers inwardly toward the front of bathtub 3, and includes a base 31, an inclined kick wall 32, and a front panel 33 in which a spout 34 and overflow drain 35 are mounted.

The upper edges of the walls of bathtub 3 define a rim 40. In this example, rim 40 includes a downwardly inclined upper surface 41 which blends into the sidewalls of bathtub 3 along a rounded edge 42. Controls 43 are mounted on rim surface 41 at the forward, left-hand side thereof.

As described in detail in co-pending U.S. patent application Ser. No. 362,485, entitled SHOWER SPRAY ARRANGEMENT FOR BATHING UNITS, a plurality of spray nozzles 44 are mounted on the left and right-hand sides of bathtub 3. The nozzles 44 mounted on the interior side of door 5 are connected with a manifold or header 45 to supply pressurized water to the nozzles.

Figure 4:
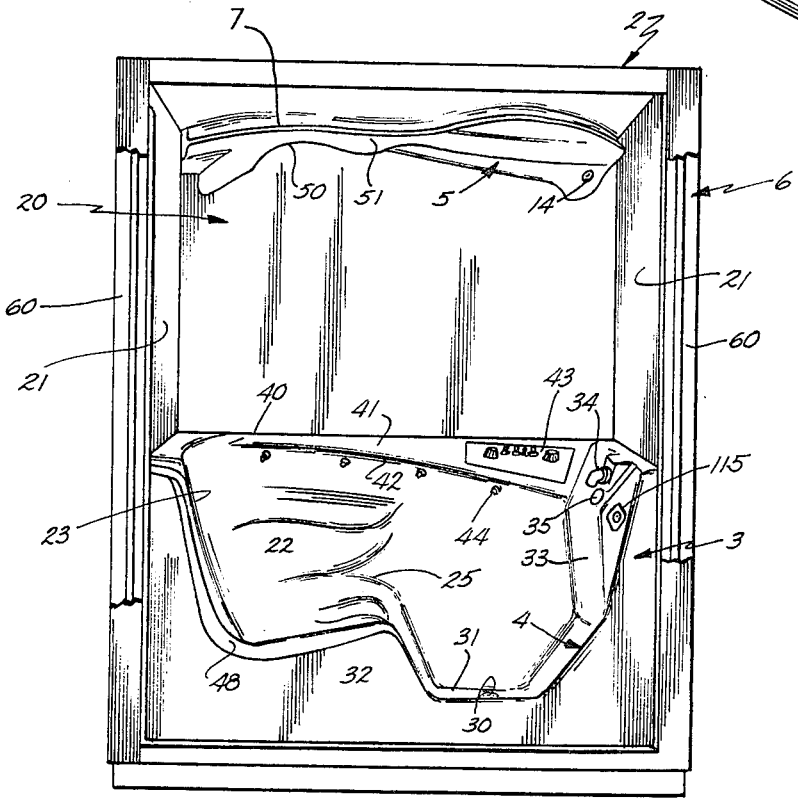
FIG. 4 is a front perspective view of the bathing apparatus, with the door shown in a raised overhead storage position.

As best illustrated in FIG. 4, bathtub opening 4 has a generally wedge-shaped countour which opens upwardly and is defined by a lip 48, which extends generally along the right-hand side of bathtub seat 22 to facilitate invalid ingress and egress. Door 5 has a substantially planar exterior side 49, and an interior side 50 with a portion of the tub interior molded integrally therewith to mate with the contour of the stationary tub half when the two halves are converged vertically. The contoured interior 50 of door 5 includes a wedge-shaped ledge 51 which mates with bathtub lip 48. Compression seal 7 is attached to the lower surface of door ledge 51, and is compressed against bathtub lip 48 when door 5 is closed to form a watertight seal therebetween for immersal bathing. Preferably, door 5 has a two wall construction (FIG. 2), with a hollow interior defined between interior and exterior walls 52 and 53 respectively. The exterior wall 53 of door 5 includes an opening 54 to access door lock 1, as well as plumbing 45 mounted therein. A removable closure panel 55 covers opening 54, and is detachably mounted on the exterior wall 53 of door 5 by removable fasteners 56. Closure panel 55 includes a recessed well or pocket 57 positioned adjacent the free end of actuator arm 8 for purposes to be described in greater detail hereinafter.

Door 5 is supported on hingeless track assembly 6, which guides door 5 vertically into the closed position shown in FIGS. 1 and 2, and pivots the door as it is raised into the horizontal, overhead storage position shown in FIG. 4. In this example, rails 60 are attached to the sidewalls 21 of enclosure 20, and have a generally inverted "L" shape. Rollers (not shown) extend from the sides of door 5, and slidably mount on the door in rails 60.

With reference to FIG. 2, actuator arm 8 is pivotally mounted between a pair of parallel ribs or braces 70 which extend transversely across the interior of door 5, and are integrally connected with the interior wall 52 of door 5. A pin 71 extends through mating apertures in braces 70 and actuator arm 8 to mount actuator arm 8 for rotation in a substantially vertical plane, as oriented when the door is closed.

Figure 6:
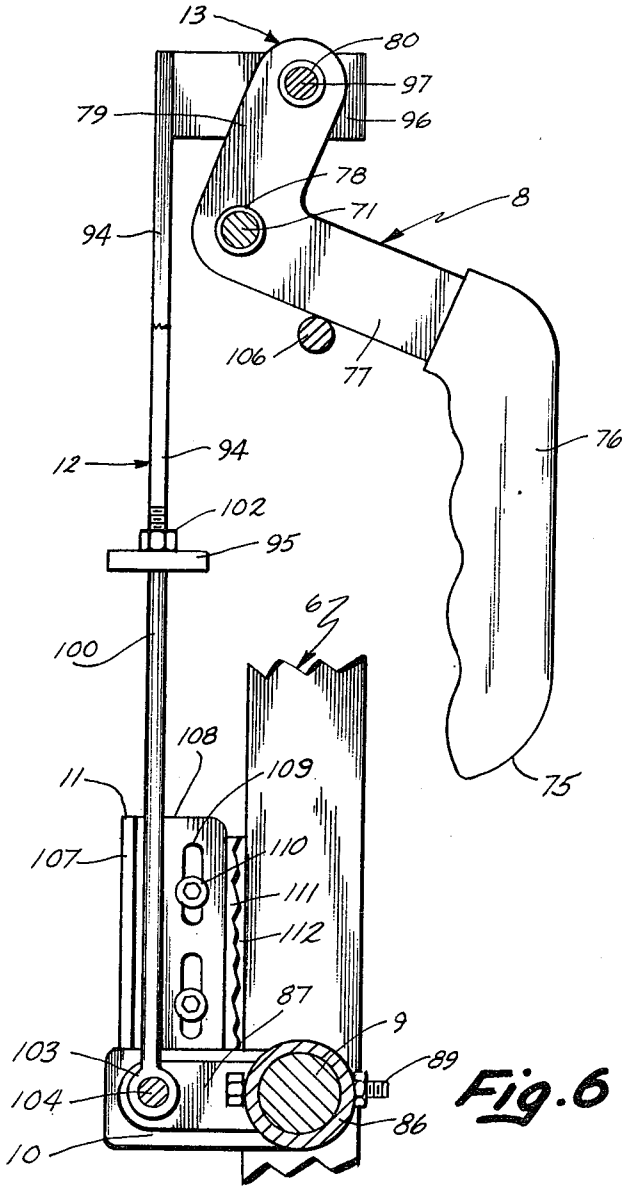
FIG. 6 is a fragmentary, side elevational view of the lock arrangement, shown in the locked position.
Figure 7:
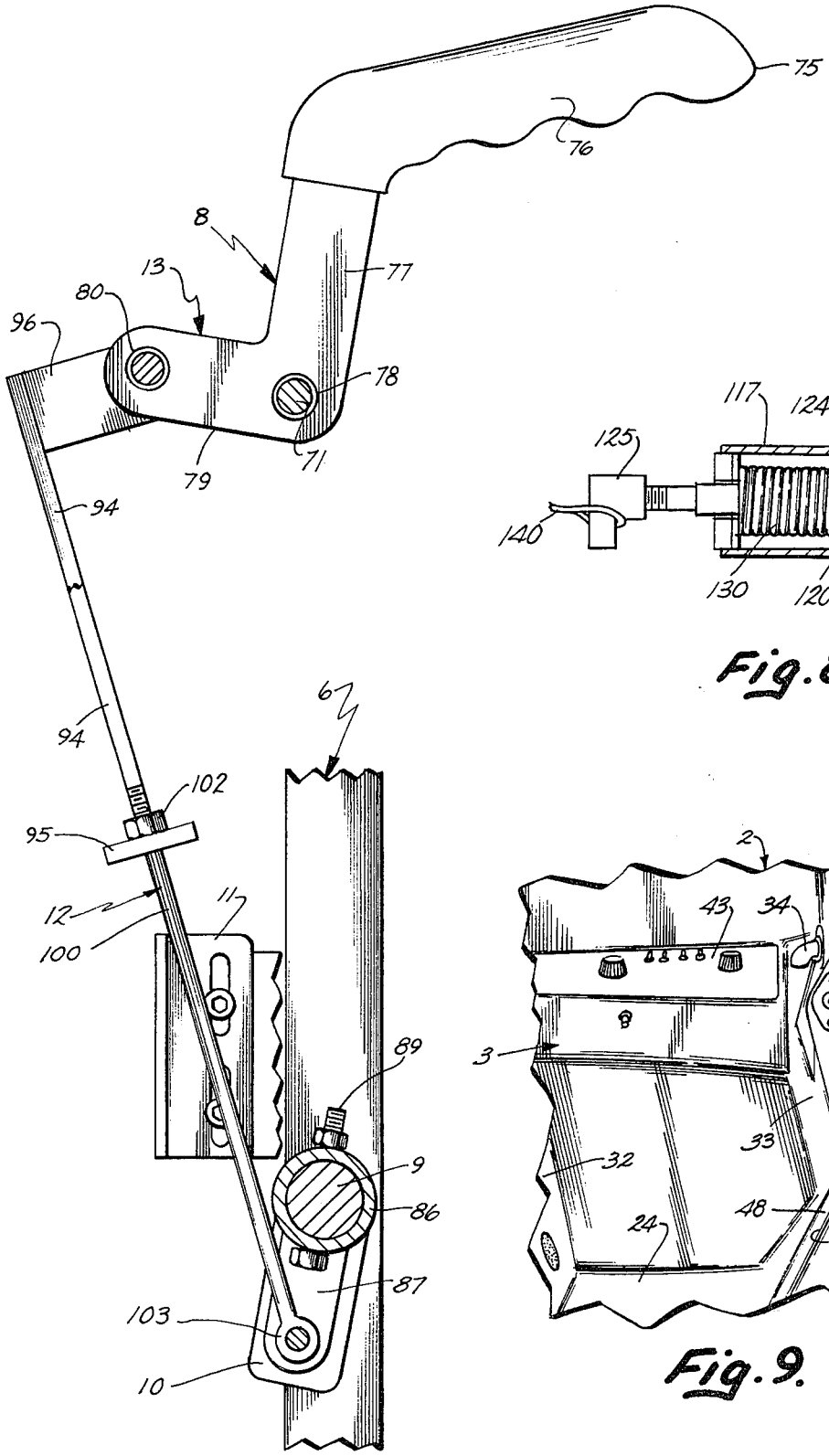
FIG. 7 is a side elevational view of the lock arrangement, shown in an unlocked position.

As best illustrated in FIGS. 6 and 7, actuator arm 8 has an irregular side elevational shape, comprising a free end 75 having a compressible grip 76 attached thereto to facilitate grasping. A medial leg 77 of actuator arm 8 is oriented at an angle of approximately 120° from end 75, and includes an aperture 78 through which mounting pin 71 extends. Sleeves 81 are positioned over pin 71 on either side of actuator arm 8 to center the arm between braces 70. The other leg 79 of actuator arm 8 is oriented at an angle of approximately 90° from leg 77, and includes an aperture 80 through the end thereof. In this example, actuator arm 8 has flat, generally parallel faces, and is constructed of bent bar stock, or the like. The outer end 75 of actuator arm 8 extends through a slot 82 (FIG. 1) in the front panel 55 of door 5. When actuator arm 8 is in the fully downward, locked position shown in FIG. 1, handle grip 76 is positioned within the pocket 57 in door panel 55, so that it is recessed from the exterior surface of the door for safety. Door pocket 57 enables the user to easily and fully grasp grip 76 to lock and unlock door 5.

Rod or bar 7 is positioned within the interior of door 5, and extends across the width of the door in the lower half thereof. The opposite ends 85 of rod 7 extend through the sidewalls or edges of door 5, and have latch arms 10 fixedly attached thereto by means such as welds or the like. Bearings (not shown) mounted in the interior of door 5, at both sides thereof, retain rod 7 in position. Rod 9 also extends through mating apertures in door braces 70. A bell crank is attached to that portion of rod 9 disposed between braces 70, and in this example comprises a sleeve 86 having a pair of parallel, laterally spaced apart arms 87 extending radially from sleeve 86 to form a clevis joint 88. Sleeve 86 is detachably connected with rod 9 by a fastener 89, or other suitable means, such that the bell crank rotates with rod 9.

Actuator arm 8 is connected with rod 9 by adjustable link mechanism 12. The upper half of link mechanism 12 comprises a pair of rods 94 having their lower ends fixedly attached to a horizontal plate 95 in a generally parallel, laterally spaced apart relationship. Outwardly extending, rectangular brackets 96 are attached to the upper ends of rods 94. The outer ends of brackets 96 include apertures therethrough which are aligned with aperture 80 in actuator arm 78. A fastener 97 pivotally connects brackets 96 with actuator arm 8. The lower half of link mechanism 12 comprises a single rod 100, having a threaded upper end 101, which extends through a mating aperture in plate 95, and includes a nut 102 mounted thereon. The lower end of rod 100 includes an eyelet 103. A fastener 104 extends through the ends of bell crank arms 87 and eyelet 103 to pivotally interconnect the same. Rotation of nut 102 varies the effective length of linkage mechanism 12 for purposes to be described in greater detail hereinafter.

Figure 5:
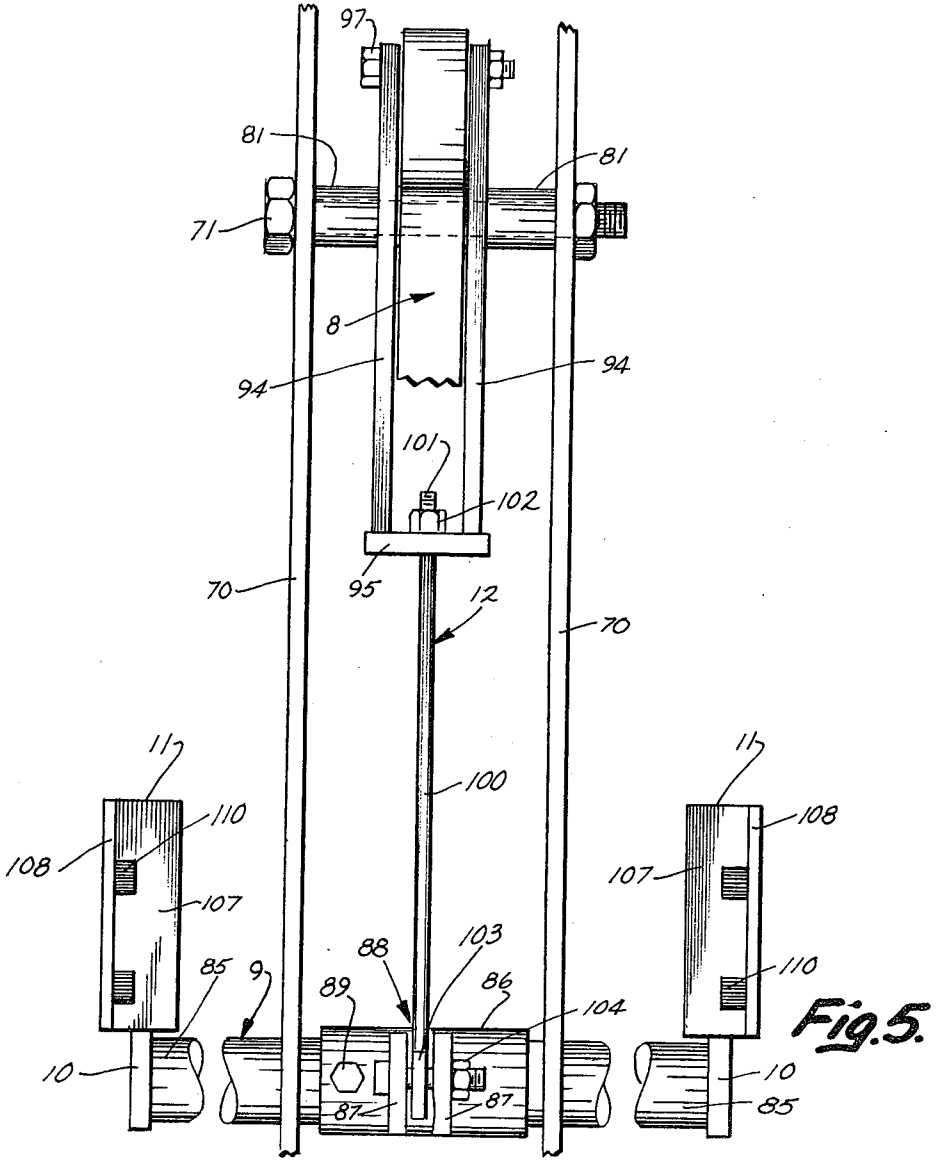
FIG. 5 is a fragmentary, front elevational view of the lock arrangement, shown in a locked position.

With reference to FIGS. 5 and 6, latch plates 11 have a generally L-shaped plan configuration, comprising forward and side flanges 107 and 108 respectively. The side flanges 108 include elongated apertures 109, through which fasteners 110 extend to adjustably connect latch plates 11 to a stationary plate 111 attached to sides of rails 60 by welds 112 or other similar means. By loosening fasteners 110, the vertical position of latch plates 11 can be adjusted to adjust downward pressure on compression seal 7, and also equalize lateral pressure on the seal.

With lock arrangement 1 in the unlocked position as shown in FIG. 7, and door 5 closed, the outer ends of latch arms 10 are pivoted downwardly to a position which permits the latch arms to translate vertically upwardly past latch plates 11. As actuator arm 8 is rotated downwardly, the outer ends of latch plates 11 pivot upwardly, and abut the forward flanges 107 of latch plates 11, such that continued rotation of the actuator arm simultaneously draws both sides of door 5 down against the mating rim 40 of bathtub 3 to compress seal 7 therebetween. When actuator arm 70 is rotated fully downwardly, it assumes an over-centered relationship with linkage mechanism 12, thereby securely retaining door 5 in the fully closed and locked position. In the locked position shown in FIG. 6, pin 97 is disposed outwardly of pin 71 to achieve the over-centered relationship. A stop 106 abuts the lower edge of arm leg 77 to retain actuator arm 8 in the locked position. The irregular configuration of actuator arm 8, and the location of pins 71 and 97, achieves a mechanical advantage in the range of 3–4 to 1. The door is unlocked by simply rotating actuator arm 8 upwardly, so that latch arms 10 are rotated out of engagement with latch plates 11. A coil spring 113 (FIG. 3) resiliently urges actuator arm 8 into the unlocked position.

Figure 8:
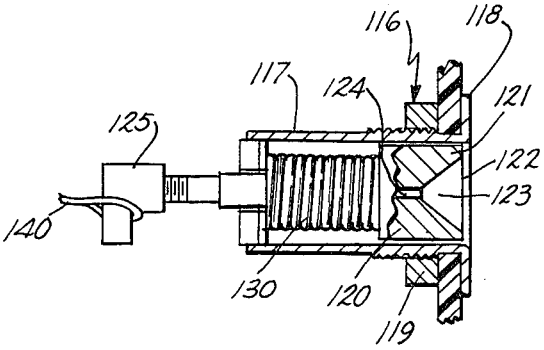
FIG. 8 is a cross-sectional view of a plumbing fitting for supplying pressurized water to spray nozzles in the door.
Figure 9:
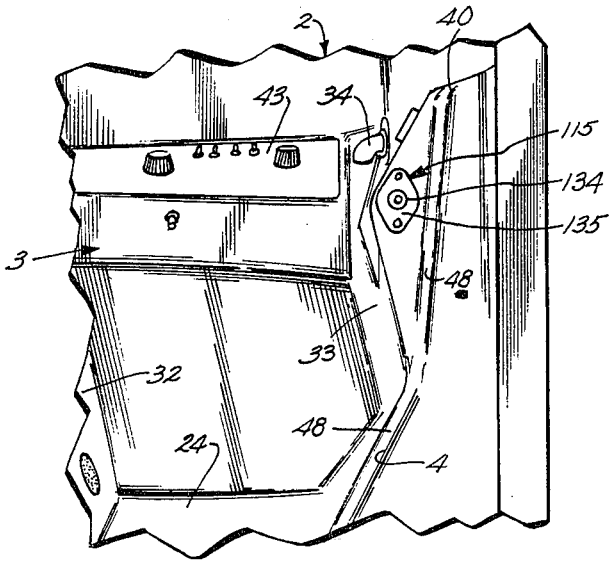
FIG. 9 is a fragmentary, front perspective view of the bathing apparatus, with the door shown in the raised position to reveal a mating plumbing fitting to supply water to the door mounted spray nozzles.

With reference to FIGS. 8 and 9, fittings 115 and 116 are mounted on bathtub 3 and door 5 respectively, and are positioned to assume a horizontally aligned configuration when door 5 is fully closed. In the illustrated example, fitting 115 is mounted in the forward wall 33 of bathtub 3, adjacent the upper portion of rim 40, and faces upwardly along a generally horizontal axis. Fitting 116 comprises a hollow cylindrical housing 117 which is received through a mating aperture in the interior wall 52 of door 5, and includes an exterior flange 118. The exterior surface of housing 118 is threaded, and a nut 119 is mounted on the threaded portion of housing 117 to securely lock the housing in door 5. A plunger 120 is slidingly and telescopingly received within the interior of housing 117, and is adapted for reciprocation therein. Plunger 120 includes a rim 121 at the outer free end 122 thereof, and a conical aperture 123, which communicates with a longitudinal aperture 124 extending through the longitudinal axis of plunger 120. A fitting 125 connects the inlet end of the manifold 45 that supplies pressurized water to each of the door mounted nozzles 44. The inner end of plunger 120 includes a shoulder on which a coil spring 130 is mounted, and resiliently urges plunger 120 outwardly.

Mating plumbing fitting 116 includes a resiliently compressible pad 134, which is supported on the exterior surface of bathtub 3 by a bracket 135. Pad 134 includes a central orifice 136 therethrough, which communicates with a supply line (not shown) for pressurized water.

With reference to FIG. 2, a cable 140 is provided to automatically reciprocate plunger 120 when door 5 is locked. In this example, the lower end of cable 140 is attached to an arm 141 anchored to rod 9. A coil spring 143 is positioned in the medial portion of cable 140 to provide resiliency thereto. The upper end of cable 140 is threaded through a pulley 144, and is attached to fitting 125, as shown in FIG. 8. The length of cable 140 is selected so that when actuator arm 8 is rotated downwardly into the unlocked position, slack is placed in cable 140, such that coil spring 130 extends plunger rim 121 into abutting contact with pad 134 to form a watertight seal therebetween. When actuator arm 8 is rotated upwardly into the unlocked position, tension is placed in cable 140, which retracts plunger 120 into housing 117, so that door 5 can be raised into the overhead storage position without interference between fittings 115 and 116.

Lock arrangement 1 provides a hand-operated mechanism which is very rugged and reliable. The mechanism is concealed within the interior of the door to create a neat, attractive appearance. The latching mechanism positively draws both sides of the door down into sealing abutment with the bathtub rim, and is adjustable to vary seal compression both downwardly and laterally. The hand-operated lock is more sensitive to the locking action of the door to prevent inadvertent damage to the bathing unit. The special plumbing fittings supply pressurized water to the door mounted shower nozzles, and are operably connected with the actuator arm to automatically converge and diverge when the door is locked and unlocked.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A bathing apparatus for invalids, comprising:

a bathtub having a lateral opening in a side thereof with sufficient size to permit invalid ingress and egress therethrough; said lateral opening being defined by a lip, and having a generally wedge-shaped contour which opens upwardly;

a door selectively closing said opening, and having a sealing edge with a generally wedge shape which conforms with the contour of said lip;

a compression seal connected with one of said lip and said door sealing edge;

means for vertically translating said door between an open position wherein invalid movement through said opening is permitted, and a closed position wherein said door and said bathtub are converged to compress said seal between said lip and said door sealing edge and form a seal therebetween which is leakproof when said bathtub is filled with water to a level substantially above a base portion of said lip for immersal bathing of an invalid; and an in-door lock arrangement for selectively locking said door in the closed position, including:

a hand-operated actuator arm pivotally mounted in said door, and having a first, free end thereof positioned to be accessed from an exterior side of said bathtub, and being shaped for grasping; said actuator arm having a fully locked position and a fully unlocked position;

an elongated bar rotatably mounted within said door, and extending longitudinally across the width of said door; said bar having opposite ends positioned adjacent to opposite sides of said door;

first and second latch arms mounted on said bar adjacent the opposite ends thereof, and rotating with said bar;

first and second latch plates mounted stationary with respect to said door during door operation, and being positioned adjacent to said latch arms for abutting contact therewith;

means for operably interconnecting said actuator arm and said bar, whereby pivotal motion of said actuator arm into the fully locked position rotates said latch arms into engagement with said latch plates, and positively pulls said door into the closed position from both sides of said door; and means for retaining said actuator arm in the fully locked position.

2. A bathing apparatus as set forth in claim 1, wherein said door has a two-wall construction with a hollow interior; and said bar extends longitudinally through the interior of said door.

3. A bathing apparatus as set forth in claim 2, wherein:

said interconnecting means includes a link mechanism having opposite ends pivotally connected with said actuator arm and said bar, and being positioned within the interior of said door.

4. A bathing apparatus as set forth in claim 3, wherein:

said retaining means includes means for attaching said link mechanism to said actuator arm in an over-centered relationship when said door is locked in the closed position.

5. A bathing apparatus as set forth in claim 4, wherein:

said actuator arm is pivotally mounted in said door at a first pivot point, and includes a second end positioned opposite said first end, and spaced apart from said first pivot point; said actuator arm second end being pivotally connected with a first end of said link and being disposed within the interior of said door.

6. A bathing apparatus as set forth in claim 5, wherein:

said bar includes an arm extending laterally thereof, with an outer end of said arm pivotally connected with a second end of said link mechanism.

7. A bathing apparatus as set forth in claim 6, including:

means for adjusting the distance between the first and second ends of said link mechanism to vary compression of said seal.

8. A bathing apparatus as set forth in claim 7, including:

means for adjusting the vertical position of said latch plates to laterally equalize compression of said seal.

9. A bathing apparatus as set forth in claim 8, wherein:

said actuator arm is recessed below the plane of the exterior surface of said door in the locked position for safety.

10. A bathing apparatus as set forth in claim 9, wherein:

said door includes a pocket in the exterior surface thereof about the first end of said actuator arm to facilitate grasping said actuator arm.

11. A bathing apparatus as set forth in claim 10, including:

means for resiliently urging said actuator arm into the unlocked position.

12. A bathing apparatus as set forth in claim 11, including:

at least one spray nozzle connected with said door, and oriented to direct a spray of water into the interior of said bathtub; and means for communicating said nozzle with a source of pressurized water when said door is in said closed position.

13. A bathing apparatus as set forth in claim 12, wherein said communicating means comprises:

a first fitting connected with said bathtub, and communicating with one of said one nozzle and said source of pressurized water;

a second fitting shaped for mating engagement with said first fitting, and communicating with the other of said one nozzle and said source of pressurized water; said second fitting being mounted on said door and translating therewith, and being positioned in alignment with said first fitting during the closed door position; and means for converging said first and second fittings into sealing engagement during the closed door position to selectively communicate said source of pressurized water with said one nozzle.

14. A bathing apparatus as set forth in claim 13, wherein:

said one of said first and second fittings comprises a plunger slidably mounted for reciprocation in one of said door and said bathtub.

15. A bathing apparatus as set forth in claim 14, wherein said converging means comprises:

a flexible line having one end connected with said bar, and the other end connected with said plunger, whereby rotation of said actuator arm between the locked and unlocked positions automatically converges and diverges said first and second fittings.

16. A bathing apparatus as set forth in claim 15, wherein:

said link mechanism is connected with said actuator arm and said bar to achieve a mechanical advantage at said bar.

17. A bathing apparatus as set forth in claim 1, wherein:

said interconnecting means includes a link mechanism having opposite ends pivotally connected with said actuator arm and said bar, and being positioned within the interior of said door.

18. A bathing apparatus as set forth in claim 17, wherein:

said retaining means includes means for attaching said link mechanism to said actuator arm in an overcentered relationship when said door is locked in the closed position.

19. A bathing apparatus as set forth in claim 1, including:

means for adjusting the vertical position of said latch plates to laterally equalize compression of said seal.

20. A bathing apparatus as set forth in claim 1, wherein:

said actuator arm is recessed below the plane of the exterior surface of said door in the locked position for safety.

21. A bathing apparatus as set forth in claim 1, wherein:

said door includes a pocket in the exterior surface thereof about the first end of said actuator arm to facilitate grasping said actuator arm.

22. A bathing apparatus as set forth in claim 1, including:

means for resiliently urging said actuator arm into the unlocked position.

23. A bathing apparatus as set forth in claim 1, including:

at least one spray nozzle connected with said door, and oriented to direct a spray of water into the interior of said bathtub; and means for communicating said nozzle with a source of pressurized water when said door is in said closed position.

24. A bathing apparatus as set forth in claim 23, wherein:

a first fitting connected with said bathtub, and communicating with one of said one nozzle and said source of pressurized water;

a second fitting shaped for mating engagement with said first fitting, and communicating with the other of said one nozzle and said source of pressurized water; said second fitting being mounted on said door and translating therewith, and being positioned in alignment with said first fitting during the closed door position; and means for converging said first and second fittings into sealing engagement during the closed door position to selectively communicate said source of pressurized water with said one nozzle.

25. A bathing apparatus as set forth in claim 24, wherein:

said one of said first and second fittings comprises a plunger slidably mounted for reciprocation in one of said door and said bathtub.

26. A bathing apparatus as set forth in claim 25, wherein:

a flexible line having one end connected with said bar, and the other end connected with said plunger, whereby rotation of said actuator arm between the locked and unlocked positions automatically converges and diverges said first and second fittings.

27. A bathing apparatus as set forth in claim 1, wherein:

said interconnecting means includes means for applying a mechanical advantage to the rotation of said bar.

* * * * *

UNITED STATES PATENT AND TRADEMARK OFFICE

CERTIFICATE OF CORRECTION

PATENT NO. : 4,399,569

DATED : August 23, 1983

INVENTOR(S) : Raymond T. Houle

It is certified that error appears in the above-identified patent and that said Letters Patent is hereby corrected as shown below:

Page 2 of the title page should be deleted to appear as per attached page.

Abstract, Page 2, line 5, "hinge-less" should be --hingeless--.

Signed and Sealed this

*Seventeenth* Day of *April 1984*

[SEAL]

*Attest:*

GERALD J. MOSSINGHOFF

*Attesting Officer* *Commissioner of Patents and Trademarks*

*Attorney, Agent, or Firm*—Price, Heneveld, Huizenga & Cooper

[57] ABSTRACT

A manual, in-door lock arrangement is provided for invalid bathing units and the like, of the type comprising a bathtub having a lateral opening in one side thereof for ingress and egress, and a door slidably mounted on a hinge-less track assembly for vertically translating the door between open and closed positions to selectively open and close the bathtub opening. A compression seal is disposed between the mating edges of the door and bathtub opening to form a watertight seal therebetween. The lock arrangement comprises a hand-operated actuator arm pivotally mounted on the exterior side of the door, and an elongate rod pivotally mounted within the door with latch arms attached to opposite ends of the rod. Latch plates are mounted on the track assembly at a location adjacent the latch arms when the door is in the closed position. A link mechanism interconnects the actuator arm and the bar, whereby downward pivotal motion of the actuator arm rotates the latch arms into engagement with the latch plates, and positively pulls the door down into the closed position. An over-centered latch mechanism securely locks the door in the closed position.

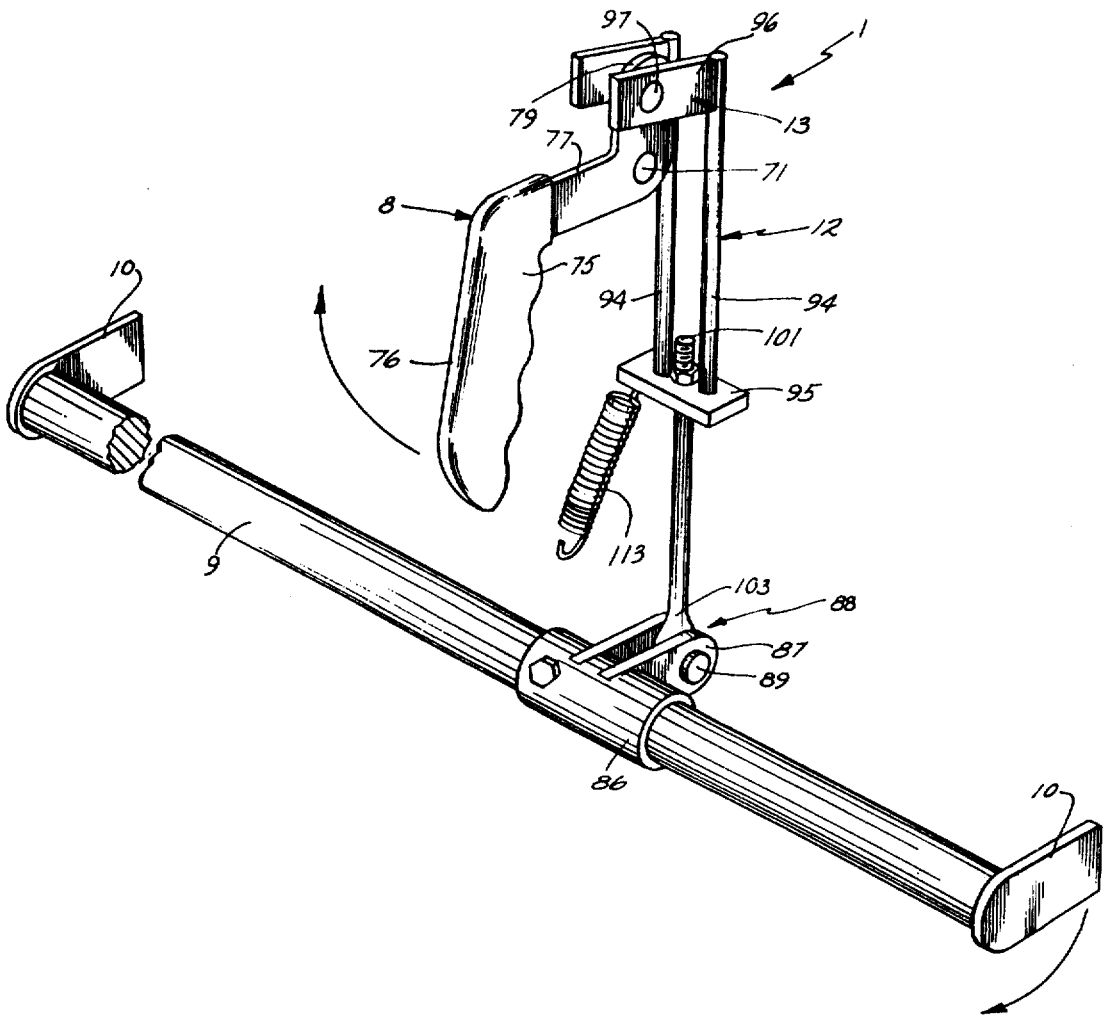

27 Claims, 9 Drawing Figures